US011248551B1

(12) United States Patent
VanDerWege et al.

(10) Patent No.: US 11,248,551 B1
(45) Date of Patent: Feb. 15, 2022

(54) METHODS AND SYSTEMS FOR PRE-CHAMBER OPERATION DURING CATALYST HEATING

(71) Applicant: Ford Global Technologies, LLC, Dearborn, MI (US)

(72) Inventors: Brad VanDerWege, Plymouth, MI (US); Joseph Basmaji, Waterford, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/146,045

(22) Filed: Jan. 11, 2021

(51) Int. Cl.

| | |
|---|---|
| ***F02D 41/06*** | (2006.01) |
| ***F02D 41/40*** | (2006.01) |
| ***F02D 37/02*** | (2006.01) |
| ***F02B 19/10*** | (2006.01) |

(52) U.S. Cl.
CPC ..... *F02D 41/064* (2013.01); *F02B 19/108* (2013.01); *F02B 19/1023* (2013.01); *F02D 37/02* (2013.01); *F02D 41/401* (2013.01); *F02D 2200/0802* (2013.01)

(58) Field of Classification Search
CPC .... F02B 19/12; F02B 19/108; F02B 19/1085; F02B 19/10; F02B 19/1023; F02B 19/109; F02D 41/064; F02D 37/02; F02D 41/401; F02D 2200/0802
USPC ..... 123/209, 253, 261, 275, 277
See application file for complete search history.

(56) References Cited

U.S. PATENT DOCUMENTS

| | | | | |
|---|---|---|---|---|
| 6,279,550 | B1 * | 8/2001 | Bryant | F02B 33/06 123/559.1 |
| 10,989,129 | B1 * | 4/2021 | Glugla | F02D 41/0002 |
| 2004/0123849 | A1 * | 7/2004 | Bryant | F01L 3/08 123/563 |
| 2018/0363539 | A1 * | 12/2018 | Shelby | F02B 19/108 |
| 2021/0246823 | A1 * | 8/2021 | Glugla | F02D 41/3094 |
| 2021/0262408 | A1 * | 8/2021 | Glugla | F02D 41/0002 |

FOREIGN PATENT DOCUMENTS

WO 2020127234 A1 6/2020

* cited by examiner

*Primary Examiner* — Sizo B Vilakazi
(74) *Attorney, Agent, or Firm* — Geoffrey Brumbaugh; McCoy Russell LLP

(57) ABSTRACT

Methods and systems are provided for operating a pre-chamber to provide ignition to a cylinder during catalyst heating. In one example, a method may include injecting fuel and air into a pre-chamber of an engine cylinder during an expansion stroke of the engine cylinder responsive to a temperature of a catalyst being less than a threshold temperature, and injecting the fuel and the air into the pre-chamber during a compression stroke of the engine cylinder responsive to the temperature of the catalyst being greater than or equal to the threshold temperature. In this way, the pre-chamber may provide robust ignition to the cylinder during a variety of operating conditions.

20 Claims, 6 Drawing Sheets

METHODS AND SYSTEMS FOR PRE-CHAMBER OPERATION DURING CATALYST HEATING

FIELD

The present description relates generally to methods and systems for engines having a pre-chamber ignition system.

BACKGROUND/SUMMARY

An internal combustion engine combusts an air-fuel mixture within cylinders to produce torque, which may be used to propel a vehicle. In some such engines, an ignition source is used to ignite the air-fuel mixture within each cylinder. For example, in traditional spark-ignition engines, each cylinder includes a spark plug for directly igniting the air-fuel mixture within the cylinder. In other examples, the air-fuel mixture within the cylinder may be ignited by jets of hot gas and flame from a pre-combustion chamber, referred to herein as a "pre-chamber." The pre-chamber may be a walled chamber located in a clearance volume of the cylinder (also referred to herein as a "main chamber" or "main combustion chamber") and may include a spark plug. When ignition is requested, the spark plug in the pre-chamber is actuated, igniting an air-fuel mixture in the pre-chamber. Jets of flame and hot gas exit the pre-chamber and enter the cylinder via one or more small orifices in the pre-chamber walls. These jets ignite the air-fuel mixture in the cylinder to produce torque.

Pre-chamber ignition may offer performance and efficiency increases over a traditional spark-ignition engine in some situations. For example, a cylinder with pre-chamber ignition may be operated with a higher dilution than a similar cylinder of a traditional spark-ignition engine, which may lead to lower fuel consumption in the cylinder with pre-chamber ignition. In other examples, a cylinder with pre-chamber ignition may produce more power than a cylinder ignited by a spark plug due to an increased burn rate in the cylinder, which may reduce an amount of time for knocking combustion to occur and thereby allow ignition timing to be advanced further toward maximum brake torque (MBT) timing.

However, it may be difficult to stably achieve the late ignition timings typically used during a catalyst heating operation using pre-chamber ignition. As one example, turbulence in the pre-chamber is largely generated from combustion chamber gases being forced into the pre-chamber through the small orifices during the compression stroke of the cylinder. However, by late in the compression stroke, this flow has already reduced significantly, and by the time ignition is desired for catalyst heating, the generated turbulence is largely dissipated. This effect is exaggerated by the fast burn rate produced by the pre-chamber. For example, to get a sufficiently late combustion phasing for catalyst heating with the fast burn rate provided via pre-chamber ignition, a later ignition timing is requested than when traditional direct spark ignition is used. As a result, the turbulence desired for fast and stable pre-chamber combustion is not present when ignition is desired, leasing to an increased incidence of pre-chamber misfire.

To address the issues associated with pre-chamber ignition during certain engine operating conditions, such as during catalyst heating, some systems may further include a spark plug directly coupled to the main combustion chamber, which may additionally or alternatively provide an ignition spark during some engine operating modes. However, including an additional spark plug in each cylinder typically uses twice as many ignition coils, which may increase production and repair costs. Further, each ignition coil may include a separate communication channel with a vehicle controller, which may increase an amount of controller processing resources used during engine operation. Further, the non-operating pre-chamber may provide a very large crevice volume in the cylinder, which may substantially increase hydrocarbon emissions during catalyst heating.

The inventors herein have identified the above-mentioned issues and have identified a method to at least partially address them. In one example, a method comprises: injecting fuel and air into a pre-chamber of an engine cylinder during an expansion stroke of the engine cylinder responsive to a desired spark timing being after top dead center of a compression stroke of the engine cylinder; and injecting the fuel and the air into the pre-chamber during the compression stroke of the engine cylinder responsive to the desired spark timing being before top dead center of the compression stroke. In this way, the pre-chamber may provide robust ignition to the cylinder even during catalyst heating.

As one example, the pre-chamber may include a single injector, and injecting the fuel and the air into the pre-chamber during the expansion stroke may include actuating the single injector after a pressure in the engine cylinder decreases to a threshold during the expansion stroke. For example, the threshold may be a pressure at which injection the fuel and the air into the pre-chamber effectively pushes out residuals from a previous combustion cycle as well as cylinder gases pushed in during the compression stroke. In some examples, the fuel and the air may be delivered via a single injector, while in other examples, the fuel and the air may be delivered by separate injectors (e.g., a pre-chamber fuel injector and a pre-chamber air injector). Further, in some examples, injecting the fuel and the air into the pre-chamber during the expansion stroke of the engine cylinder may include injecting the fuel and the air into the pre-chamber no earlier than 20 degrees after top dead center during the expansion stroke. For example, the pressure in the engine cylinder may be less than or equal to the threshold by 20 degrees after top dead center.

As another example, the method may further include actuating a spark plug of the pre-chamber during the expansion stroke, after injecting the fuel and the air into the pre-chamber, while the desired spark timing is after top dead center of the compression stroke, and actuating the spark plug of the pre-chamber during the compression stroke, after injecting the fuel and the air into the pre-chamber, while the desired spark timing is before top dead center of the compression stroke. For example, the desired spark timing may be after top dead center of the compression stroke when a temperature of a catalyst is less than a threshold temperature and may be before top dead center of the compression stroke when the temperature of the catalyst is greater than the threshold temperature. As an example, a timing of actuating the spark plug of the pre-chamber may be determined based on the temperature of the catalyst while the temperature of the catalyst is less than the threshold and may be determined based on a desired torque output of the engine cylinder, and not the temperature of the catalyst, while the temperature of the catalyst is greater than or equal to the threshold temperature. For example, the timing may be further delayed as the temperature of the catalyst further decreases below the threshold temperature in order to increase an amount of waste heat provided to the catalyst.

In this way, the pre-chamber gases may be effectively purged while introducing turbulence in the pre-chamber that does not have time to dissipate before spark is provided, enabling efficient and reliable pre-chamber ignition across a range of operating conditions. By using pre-chamber ignition during catalyst heating, the cylinder may be operated at a higher dilution than when traditional direct spark ignition is used. As a result, vehicle emissions prior to the catalyst reaching its light-off temperature may be reduced. Further, a cost of the system may be reduced by not including both the pre-chamber and a cylinder spark plug.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
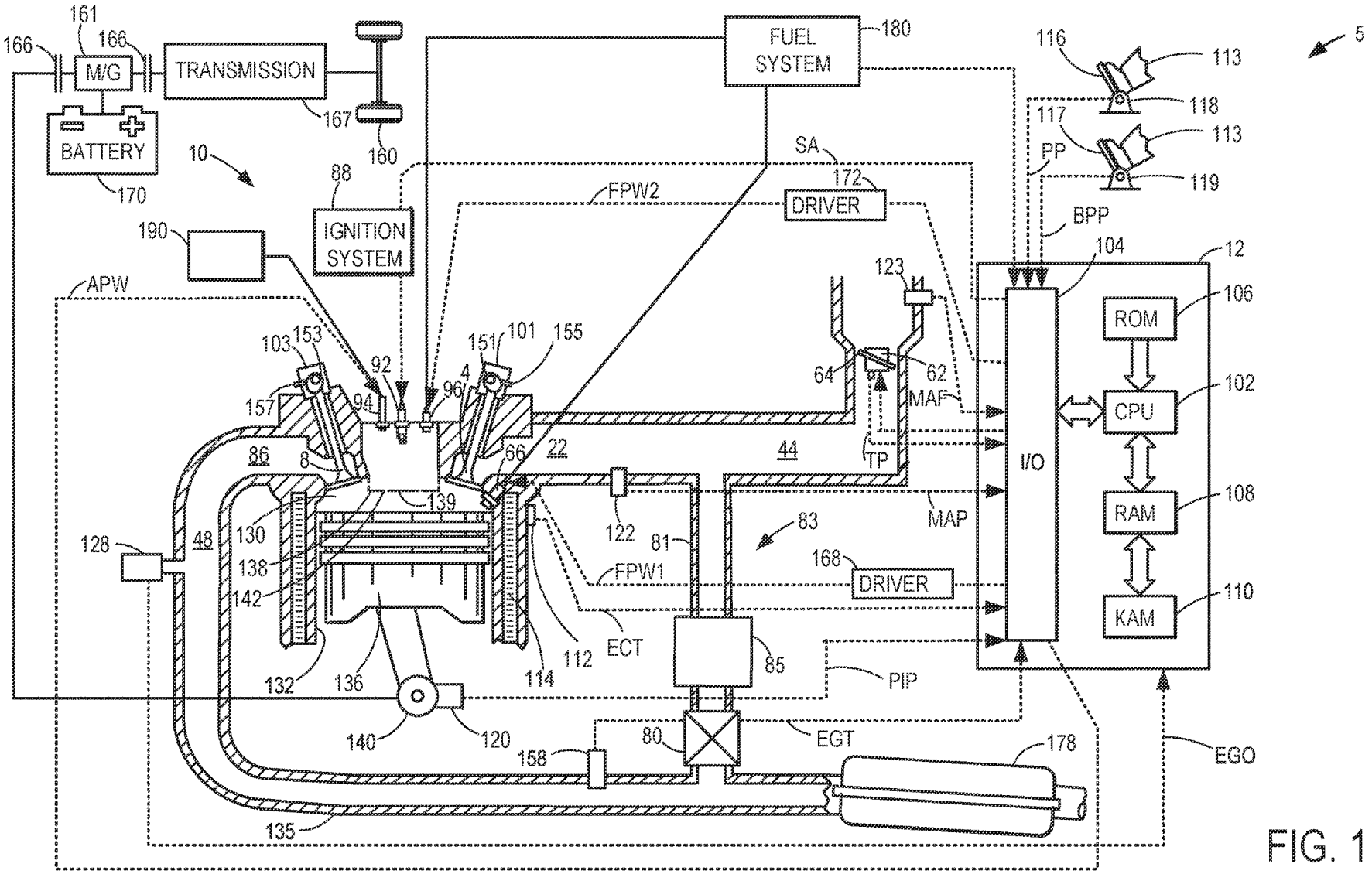
FIG. 1 shows a schematic depiction of a cylinder including a pre-chamber in an engine system of a vehicle.
Figure 2:
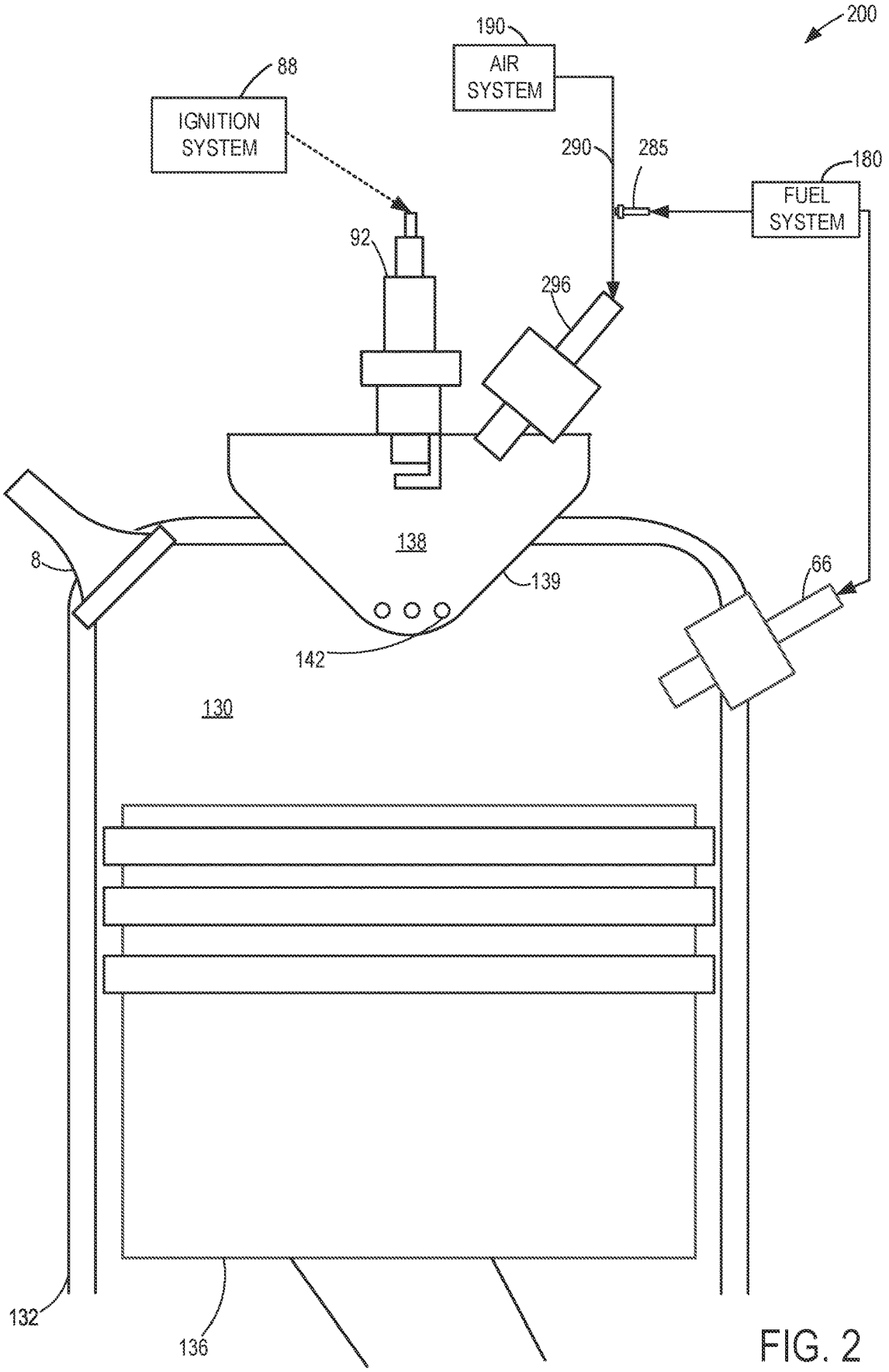
FIG. 2 schematically shows a partial view of an alternative configuration of the pre-chamber of FIG. 1.
Figure 4:
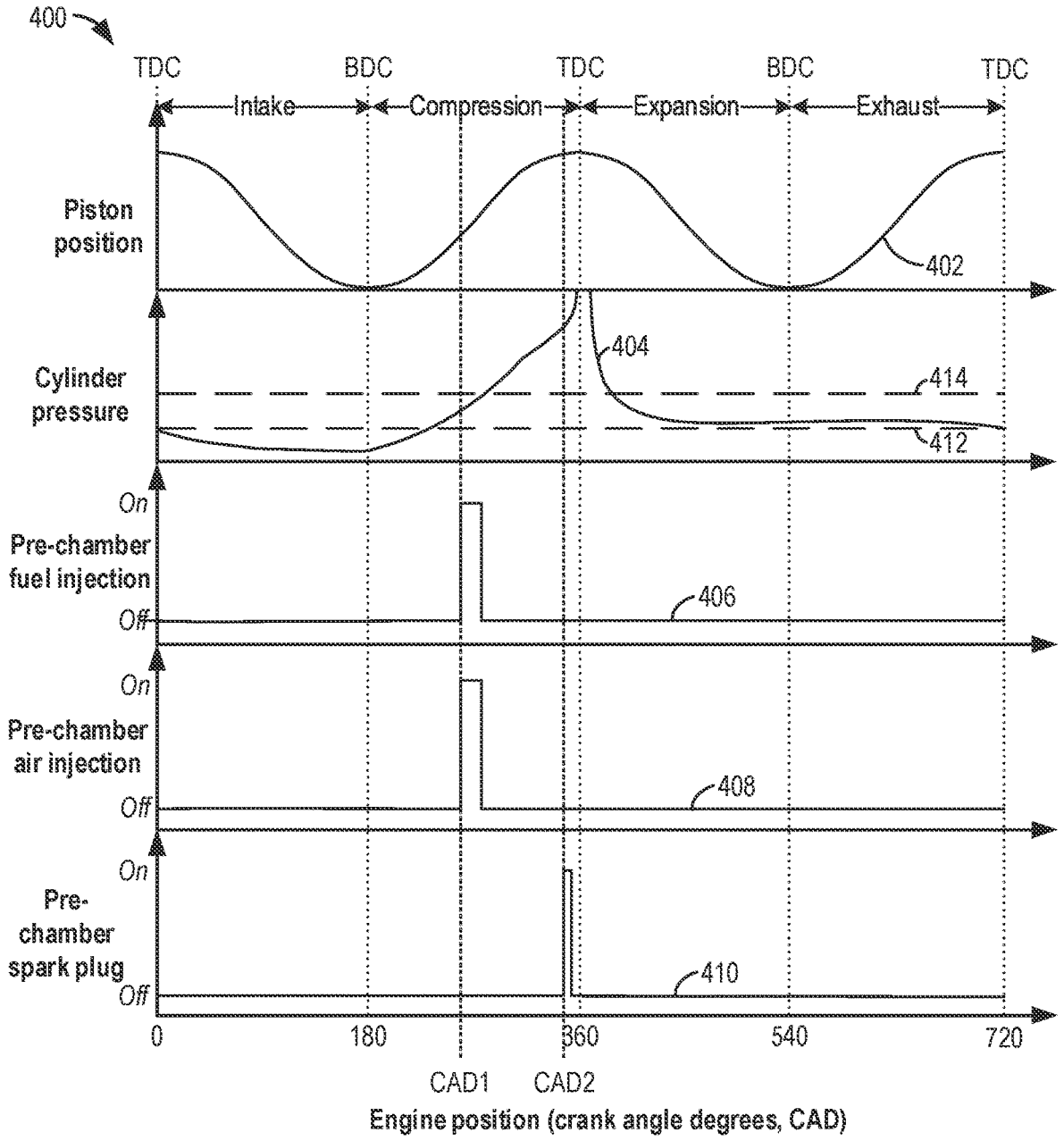
FIG. 4 shows an example timing chart of operating a cylinder and pre-chamber when a catalyst heating condition is not present.
Figure 5:
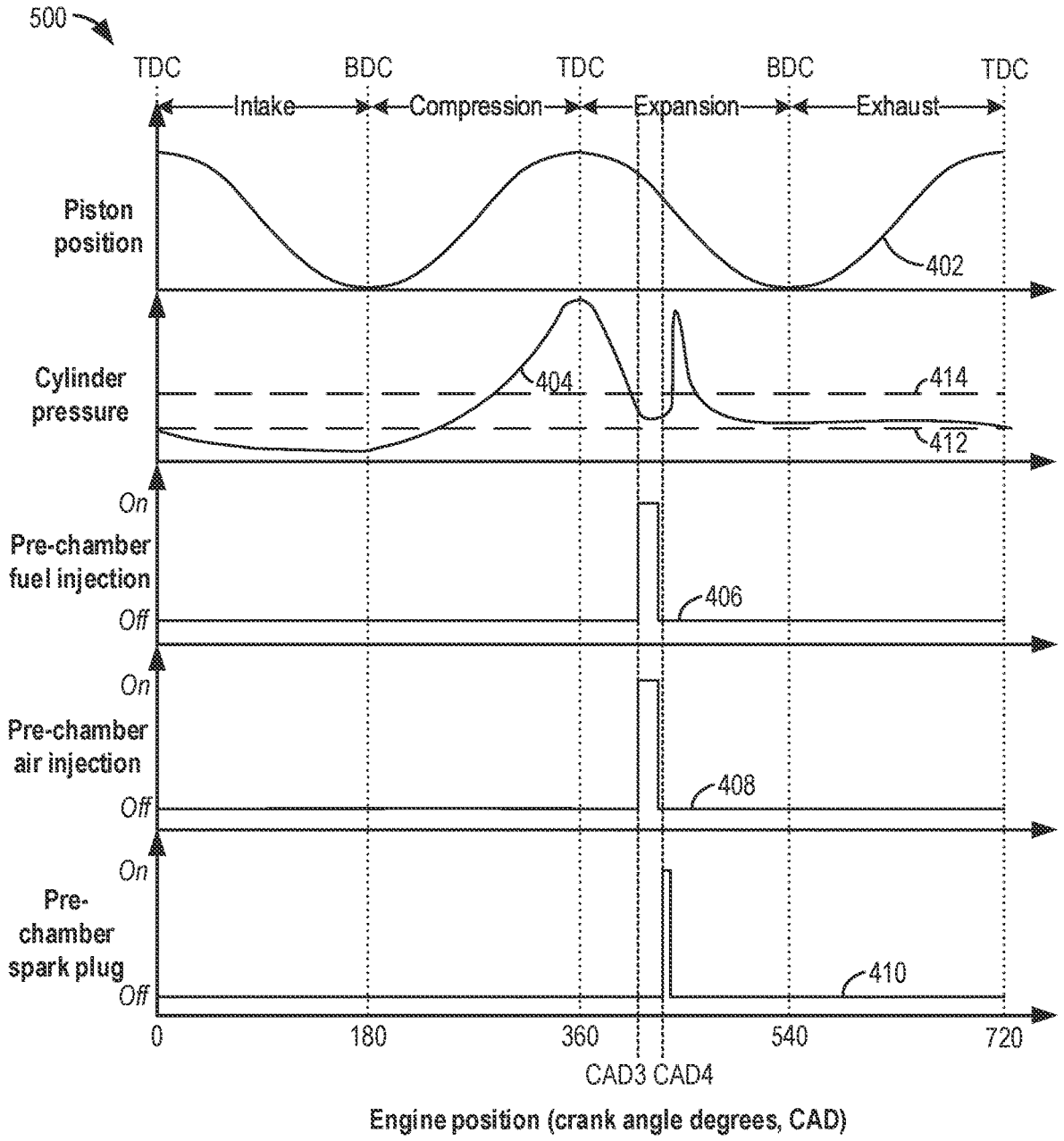
FIG. 5 shows an example timing chart of operating a cylinder and pre-chamber when a catalyst heating condition is present.
Figure 6:
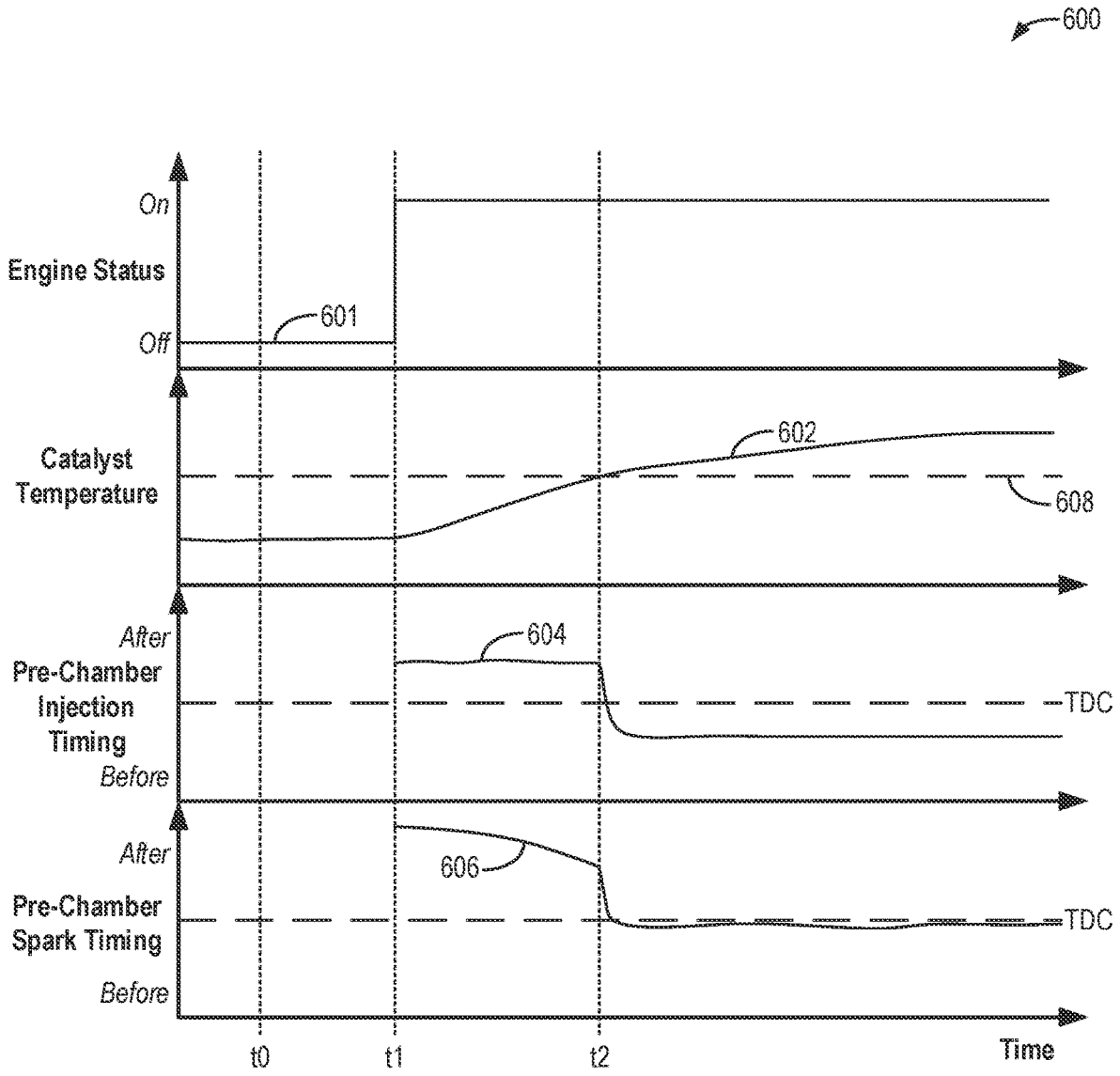
FIG. 6 shows a prophetic example timeline for adjusting purge and ignition timing in a pre-chamber based on a condition of a catalyst.

The following description relates to systems and methods for providing pre-chamber ignition during catalyst heating. The cylinder may have a cylinder configuration comprising an active pre-chamber that includes a spark plug and at least one injector for injecting fuel and/or air. Note that as used herein, the term "air" may refer to ambient air, pure oxygen (e.g., $O_2$), another combustible gas (e.g., hydrogen) or a mixture of such gases (e.g., oxygen-enriched air). In particular, FIG. 1 shows an example where the pre-chamber includes separate air and fuel injectors, whereas FIG. 2 shows an example where the pre-chamber includes a single injector that injects pre-mixed fuel and air. The pre-chamber may be operated to provide an ignition source to the cylinder even during catalyst heating, such as according to the method of FIG. 3. FIG. 4 shows an example timing chart of pre-chamber injection and spark timings for providing pre-chamber ignition to a cylinder when a catalyst heating condition is not present, whereas FIG. 5 shows an example timing chart of the pre-chamber injection and spark timings for providing pre-chamber ignition to the cylinder when the catalyst heating condition is present. An example timeline for adjusting the pre-chamber injection and spark timings based on the temperature of the catalyst is shown in FIG. 6.

Turning now to the figures, FIG. 1 shows a partial view of a single cylinder 130 of an internal combustion engine 10 that may be included in a vehicle 5. Engine 10 may be a multi-cylinder engine, and only one cylinder 130 is shown in FIG. 1. Cylinder (e.g., combustion chamber) 130 includes a coolant sleeve 114 and cylinder walls 132, with a piston 136 positioned therein and connected to a crankshaft 140. Combustion chamber 130 is shown communicating with an intake manifold 44 via an intake valve 4 and an intake port 22 and with an exhaust manifold 48 via an exhaust valve 8 and an exhaust port 86. A throttle 62 including a throttle plate 64 may be provided in an intake passage upstream of intake manifold 44 for varying a flow rate and/or pressure of intake air provided to the engine cylinders.

Engine 10 may be controlled at least partially by a controller 12 and by input from a vehicle operator 113 via an accelerator pedal 116 and an accelerator pedal position sensor 118 and via a brake pedal 117 and a brake pedal position sensor 119. The accelerator pedal position sensor 118 may send a pedal position signal (PP) to controller 12 corresponding to a position of accelerator pedal 116, and the brake pedal position sensor 119 may send a brake pedal position (BPP) signal to controller 12 corresponding to a position of brake pedal 117.

In some examples, vehicle 5 may be a hybrid vehicle with multiple sources of torque available to one or more vehicle wheels 160. In other examples, vehicle 5 is a conventional vehicle with only an engine. In the example shown in FIG. 1, the vehicle includes engine 10 and an electric machine 161. Electric machine 161 may be a motor or a motor/generator and thus may also be referred to herein as an electric motor. Electric machine 161 receives electrical power from a traction battery 170 to provide torque to vehicle wheels 160. Electric machine 161 may also be operated as a generator to provide electrical power to charge battery 170, for example, during a braking operation.

Crankshaft 140 of engine 10 and electric machine 161 are connected via a transmission 167 to vehicle wheels 160 when one or more clutches 166 are engaged. In the depicted example, a first clutch 166 is provided between crankshaft 140 and electric machine 161, and a second clutch 166 is provided between electric machine 161 and transmission 167. Controller 12 may send a signal to an actuator of each clutch 166 to engage or disengage the clutch, so as to connect or disconnect crankshaft 140 from electric machine 161 and the components connected thereto, and/or connect or disconnect electric machine 161 from transmission 167 and the components connected thereto. Transmission 167 may be a gearbox, a planetary gear system, or another type of transmission. The powertrain may be configured in various manners including as a parallel, a series, or a series-parallel hybrid vehicle.

An exhaust passage 135 can receive exhaust gases from other cylinders of engine 10 in addition to cylinder 130. An exhaust gas sensor 128 is shown coupled to exhaust passage 135 upstream of an emission control device 178. Exhaust gas sensor 128 may be selected from among various suitable sensors for providing an indication of an exhaust gas air-fuel ratio (AFR), such as a linear oxygen sensor or UEGO (universal or wide-range exhaust gas oxygen), a two-state oxygen sensor or EGO (as depicted), a HEGO (heated EGO), a NOx sensor, a HC sensor, or a CO sensor, for example. Emission control device 178 may be a three-way catalyst, a NOx trap, various other emission control devices, or combinations thereof.

In the depicted view, intake valve 4 and exhaust valve 8 are located at an upper region of combustion chamber 130. Intake valve 4 and exhaust valve 8 may be controlled by controller 12 using respective cam actuation systems including one or more cams. The cam actuation systems may utilize one or more of variable displacement engine (VDE), cam profile switching (CPS), variable cam timing (VCT), variable valve timing (VVT), and/or variable valve lift (VVL) systems to vary valve operation. In the depicted example, intake valve 4 is controlled by an intake cam 151, and exhaust valve 8 is controlled by an exhaust cam 153. The intake cam 151 may be actuated via an intake valve timing actuator 101 and the exhaust cam 153 may be actuated via an exhaust valve timing actuator 103 according to set intake and exhaust valve timings, respectively. In some examples, the intake valves and exhaust valves may be deactivated via the intake valve timing actuator 101 and exhaust valve timing actuator 103, respectively. The position of intake cam 151 and exhaust cam 153 may be determined by camshaft position sensors 155 and 157, respectively.

In some examples, the intake and/or exhaust valve may be controlled by electric valve actuation. For example, cylinder 130 may alternatively include an intake valve controlled via electric valve actuation and an exhaust valve controlled via cam actuation, including CPS and/or VCT systems. In still other examples, the intake and exhaust valves may be controlled by a common valve actuator or actuation system or a variable valve timing actuator or actuation system. The various valve control systems may be used to vary a timing, open duration, and lift of intake valve 4 and exhaust valve 8.

Cylinder 130 can have a compression ratio, which is a ratio of volumes when piston 136 is at bottom dead center to top dead center. Conventionally, the compression ratio is in a range of 9:1 to 13:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock.

As a non-limiting example, cylinder 130 is shown including a cylinder fuel injector 66. Fuel injector 66 is shown coupled directly to combustion chamber 130 for injecting fuel directly therein in proportion to a pulse-width of a signal FPW1 received from controller 12 via an electronic driver 168. In this manner, fuel injector 66 provides what is known as direct injection (hereafter also referred to as "DI") of fuel into cylinder 130. In another example, injector 66 may be a port injector providing fuel into the intake port upstream of cylinder 130. Further, while FIG. 1 shows fuel injected to the cylinder via a single injector, the engine may alternatively be operated by injecting fuel via multiple injectors, such as one direct injector and one port injector. For example, both port and direct injectors may be included in a configuration that is known as port fuel and direct injection (PFDI). In such a configuration, controller 12 may vary a relative amount of injection from each injector. In some examples, cylinder 130 may include additional fuel injectors.

Fuel may be delivered to fuel injector 66 from a high pressure fuel system 180 including one or more fuel tanks, fuel pumps, and a fuel rail. Alternatively, fuel may be delivered by a single stage fuel pump at a lower pressure. Further, while not shown, the fuel tanks may include a pressure transducer providing a signal to controller 12. Fuel tanks in fuel system 180 may hold fuel with different fuel qualities, such as different fuel compositions. These differences may include different alcohol content, different octane, different heats of vaporization, different fuel blends, and/or combinations thereof, etc. One example of fuels with different heats of vaporization includes gasoline as a first fuel type with a lower heat of vaporization and ethanol as a second fuel type with a greater heat of vaporization. In another example, the engine may use gasoline as a first fuel type and an alcohol-containing fuel blend, such as E85 (which is approximately 85% ethanol and 15% gasoline) or M85 (which is approximately 85% methanol and 15% gasoline), as a second fuel type. Other feasible substances include water, methanol, a mixture of ethanol and water, a mixture of water and methanol, a mixture of alcohols, etc. In this way, air and fuel are delivered to cylinder 130, which may produce a combustible air-fuel mixture.

Fuel may be delivered by fuel injector 66 to cylinder 130 during a single cycle of the cylinder. Further, the distribution and/or relative amount of fuel delivered from cylinder fuel injector 66 may vary with operating conditions. Furthermore, for a single combustion event, multiple injections of the delivered fuel may be performed per cycle. The multiple injections may be performed during the compression stroke, intake stroke, or any appropriate combination thereof.

In the example shown in FIG. 1, each cylinder 130 of engine 10 comprises a pre-chamber 138 for initiating combustion. Pre-chamber 138 is defined by pre-chamber walls 139 and includes a spark plug 92, an air injector 94, and a pre-chamber fuel injector 96. Air injector 94 is shown directly coupled to pre-chamber 138 for injecting air and/or oxygen into the pre-chamber. In some examples, air injector 94 is an electromagnetic (e.g., solenoid) injector. Air may be delivered to air injector 94 from a pre-chamber air system 190. Note that in relation to pre-chamber air system 190, the term "air" may refer herein to ambient air, oxygen (e.g., $O_2$), hydrogen (e.g., $H_2$), another combustible gas, or a mixture of such gases. In some examples, air injector 94 may inject air received from pre-chamber air system 190 into pre-chamber 138 in proportion to a pulse-width of a signal APW received from controller 12 via pre-chamber air system 190. In some examples, pre-chamber air system 190 supplies air injector 94 with ambient air from an air intake passage of the engine, which may be pressurized before injection (e.g., via a compressor or pump). In other examples, pre-chamber air system 190 supplies air injector 94 with onboard-generated $O_2$, which may be stored in a pressurized tank before injection. For example, the pressurized tank of pre-chamber air system 190 may be maintained at a desired pressure by an associated pump. A pressure differential between the pressurized tank and the pre-chamber and an open time of air injector 94 (e.g., as determined by the pulse-width of the signal APW) may determine the mass of air delivered to pre-chamber 138, for example.

Pre-chamber fuel injector 96 is shown coupled directly to pre-chamber 138 for directly injecting fuel therein in proportion to a pulse-width of a signal FPW2 received from controller 12 via an electronic driver 172. Fuel may be provided to pre-chamber fuel injector 96 by high-pressure fuel system 180, described above. Alternatively, fuel may be provided to pre-chamber fuel injector 96 from a dedicated pre-chamber fuel system that may be included within or distinct from high-pressure fuel system 180. In still another example, pre-chamber fuel injector 96 may inject a mixture of air and fuel, as will be described below with respect to FIG. 2. Thus, both air and fuel are delivered to pre-chamber 138, which may produce an air-fuel mixture with an air/fuel ratio (AFR) that may differ from an AFR in cylinder 130. In one example, the AFR in pre-chamber 138 may be richer (e.g., have a higher proportion of fuel relative to air) than the AFR in cylinder 130. In another example, the AFR in the pre-chamber may be the same as the AFR in the cylinder. In yet another example, the AFR in pre-chamber 138 may be leaner (e.g., have a higher proportion of air relative to fuel) than the AFR in cylinder 130.

Further, the pre-chamber walls 139 include a plurality of openings 142. The plurality of openings 142 provide orifices between pre-chamber 138 and cylinder 130, fluidically coupling an interior of pre-chamber 138 to an interior of cylinder 130. As such, during some conditions, gases may flow between the interior of pre-chamber 138 and the interior of cylinder 130. For example, the gases (e.g., air, fuel, and/or residual combustion gases) may flow through each of the plurality of openings 142 with a directionality and rate based on a pressure difference across each of the plurality of openings 142 (e.g., between the interior of pre-chamber 138 and the interior of cylinder 130). The plurality of openings 142 may also provide an ignition flame from pre-chamber 138 to cylinder 130, as will be elaborated below.

In the example shown, pre-chamber 138 is positioned directly overhead of piston 136, in a clearance volume of cylinder 130. However, other positions for pre-chamber 138 are also possible. In one example, pre-chamber 138 may be positioned on one side of cylinder 130 and coupled to the clearance volume via the plurality of openings 142. As another example, pre-chamber 138 may be aligned proximate to intake valve 4, along an air flow path between intake valve 4 and cylinder 130.

An ignition system 88 may provide an ignition spark to pre-chamber 138 via spark plug 92 in response to a spark advance signal SA from controller 12, under select operating modes. A timing of signal SA may be adjusted based on engine operating conditions and a driver torque demand. For example, spark may be provided at maximum brake torque (MBT) timing to maximize engine power and efficiency. Controller 12 may input engine operating conditions, including an engine speed, an engine load, and an exhaust gas AFR, into a look-up table, which may output the corresponding MBT timing for the input engine operating conditions. In other examples, spark may be retarded from MBT to prevent an occurrence of knock. In still other examples, spark may be retarded from MBT to reduce engine torque, such as due to a decrease in the driver-demanded torque or a transmission gear shift event. When spark plug 92 provides the ignition spark to pre-chamber 138, the air-fuel mixture within the pre-chamber may combust, with the increased pressure of combustion sending jets of flame and hot gases into cylinder 130 via the plurality of openings 142. The plurality of openings 142 may be arranged such that the jets of flame are evenly distributed in cylinder 130. The jets of flame may ignite the air-fuel mixture in cylinder 130, causing combustion. After combustion, a mixture of exhaust gases from both pre-chamber 138 and cylinder 130 may be exhausted from cylinder 130 to exhaust manifold 48 via opening of exhaust valve 8.

External exhaust gas recirculation (EGR) may be provided to the engine via a high pressure EGR system 83, delivering exhaust gas from a zone of higher pressure in exhaust passage 135 to a zone of lower pressure in intake manifold 44, downstream of throttle 62, via an EGR passage 81. However, in other examples, engine 10 may additionally or alternatively include a low pressure EGR system (e.g., a low-pressure loop). An amount EGR provided to intake manifold 44 may be varied by controller 12 via an EGR valve 80. For example, controller 12 may be configured to actuate and adjust a position of EGR valve 80 to adjust the amount of exhaust gas flowing through EGR passage 81. EGR valve 80 may be adjusted between a fully closed position, in which exhaust gas flow through EGR passage 81 is blocked, and a fully open position, in which exhaust gas flow through the EGR passage is maximally enabled. As an example, EGR valve 80 may be continuously variable between the fully closed position and the fully open position. As such, the controller may increase a degree of opening of EGR valve 80 to increase an amount of EGR provided to intake manifold 44 and decrease the degree of opening of EGR valve 80 to decrease the amount of EGR provided to intake manifold 44. As an example, EGR valve 80 may be an electronically activated solenoid valve. In other examples, EGR valve 80 may be positioned by an incorporated stepper motor, which may be actuated by controller 12 to adjust the position of EGR valve 80 through a range of discreet steps (e.g., 52 steps), or EGR valve 80 may be another type of flow control valve. Further, EGR may be cooled via passing through an EGR cooler 85 within EGR passage 81. EGR cooler 85 may reject heat from the EGR gases to engine coolant, for example.

Under some conditions, EGR system 83 may be used to regulate a temperature of the air and fuel mixture within the combustion chamber. Further, EGR may be desired to attain a desired engine dilution, thereby increasing fuel efficiency and emissions quality, such as emissions of nitrogen oxides. As an example, EGR may be requested at low-to-mid engine loads. Thus, it may be desirable to measure or estimate an EGR mass flow. EGR sensors may be arranged within EGR passage 81 and may provide an indication of one or more of mass flow, pressure, and temperature of the exhaust gas, for example. An amount of EGR requested may be based on engine operating conditions, including engine load (as estimated via accelerator pedal position sensor 118), engine speed (as estimated via a crankshaft acceleration sensor), engine temperature (as estimated via an engine coolant temperature sensor 112), etc. For example, controller 12 may refer to a look-up table having the engine speed and load as the input and output a desired amount of EGR corresponding to the input engine speed-load. In another example, controller 12 may determine the desired amount of EGR (e.g., desired EGR flow rate) through logic rules that directly take into account parameters such as engine load, engine speed, engine temperature, etc. In still other examples, controller 12 may rely on a model that correlates a change in engine load with a change in a dilution request, and further correlates the change in the dilution request with a change in the amount of EGR requested. For example, as the engine load increases from a low load to a mid load, the amount of EGR requested may increase, and then as the engine load increases from a mid load to a high load, the amount of EGR requested may decrease. Controller 12 may further determine the amount of EGR requested by taking into account a best fuel economy mapping for a desired dilution rate. After determining the amount of EGR requested, controller 12 may refer to a look-up table having the requested amount of EGR as the input and a signal corresponding to a degree of opening to apply to EGR valve 80 (e.g., as sent to the stepper motor or other valve actuation device) as the output.

Controller 12 is shown in FIG. 1 as a microcomputer, including a microprocessor unit 102, input/output ports 104, an electronic storage medium for executable programs and calibration values shown as a read only memory 106 in this particular example, a random access memory 108, a keep alive memory 110, and a data bus. Storage medium read-only (e.g., non-transitory) memory 106 can be programmed with computer readable data representing instructions executable by microprocessor 102 for performing the methods and routines described herein as well as other variants that are anticipated but not specifically listed.

Controller 12 may receive various signals from sensors coupled to engine 10, in addition to those signals previously discussed, including a measurement of inducted mass air flow (MAF) from a mass air flow sensor 123, an engine coolant temperature signal (ECT) from engine coolant temperature sensor 112 coupled to coolant sleeve 114, signal EGO from exhaust gas sensor 128, which may be used by controller 12 to determine the AFR of the exhaust gas, an exhaust gas temperature signal (EGT) from a temperature sensor 158 coupled to exhaust passage 135, a profile ignition pickup signal (PIP) from a Hall effect sensor 120 (or other type) coupled to crankshaft 140, a throttle position (TP) from a throttle position sensor coupled to throttle 62, and an absolute manifold pressure signal (MAP) from a MAP sensor 122 coupled to intake manifold 44. An engine speed signal, RPM, may be generated by controller 12 from signal PIP. Further, Hall effect sensor 120 may comprise a crankshaft position sensor, and controller 12 may also determine crankshaft position (e.g., in crank angle degrees) from signal PIP. The manifold pressure signal MAP from the manifold pressure sensor may be used to provide an indication of vacuum or pressure in the intake manifold.

Based on input from one or more of the above-mentioned sensors, controller 12 may adjust one or more actuators, such as cylinder fuel injector 66, throttle 62, spark plug 92, pre-chamber fuel injector 96, pre-chamber air injector 94, the intake/exhaust valves and cams, etc. The controller may receive input data from the various sensors, process the input data, and trigger the actuators in response to the processed input data based on instruction or code programmed therein corresponding to one or more routines, an example of which is described with respect to FIG. 3.

Continuing to FIG. 2, an alternative configuration of pre-chamber 138 that includes a combined air and fuel injection system 200 is shown. Components of FIG. 2 that function the same as components shown in FIG. 1 are numbered the same and will not be re-introduced. Further, it may be understood that components illustrated in FIG. 1 that are not shown in FIG. 2 may be present, except for the differences described below.

In the example shown in FIG. 2, pre-chamber 138 includes a single injector 296 (e.g., instead of pre-chamber air injector 94 and pre-chamber fuel injector 96 shown in FIG. 1). Injector 296 receives pre-mixed fuel and air from a delivery passage 290. As an example, delivery passage 290 may be fluidically coupled to each of air system 190 and fuel system 180. In the present example, a fuel injector 285 injects fuel into delivery passage 290 downstream of air system 190. In other examples, fuel injector 285 may inject fuel into delivery passage 290 upstream of air system 190. Delivery passage 290 may receive fuel from fuel system 180 and receive air from air system 190 in a desired proportion to generate an air-fuel mixture within delivery passage 290 that has a desired AFR for operating pre-chamber 138 (e.g., stoichiometry). The air-fuel mixture may then be injected into pre-chamber 138 via injector 296 according to a pulse-width of an injection signal generated by controller 12 (shown in FIG. 1). Further, delivery passage 290 may supply the air-fuel mixture to every pre-chamber of the engine, and thus, one fuel injector 285 may provide fuel for every pre-chamber of the engine.

In still other examples, injector 296 may be an air-assisted injector that uses air pressure directly received from air system 190 to help atomize the fuel received from fuel system 180. By including a single air-fuel injector or an air-assisted fuel injector, the injected fuel and air may be more quickly and/or more thoroughly mixed compared with using separate air and fuel injectors, as shown in FIG. 1 (pre-chamber air injector 94 and pre-chamber fuel injector 96), enabling more accurate AFR control and faster ignition after injection. Further, the single injector 296 may reduce packaging constraints in the cylinder head compared with separate pre-chamber air and fuel injectors.

The configurations shown in FIGS. 1-2 may provide increased combustion stability relative to systems without direct air and fuel injection due to more accurate AFR control in the pre-chamber. For example, during light load operation, direct air injection may reduce an occurrence of misfire by providing additional $O_2$ for combustion. As another example, direct air and/or fuel injection into the pre-chamber may purge residual gas from previous combustion events in the pre-chamber via a pressure differential between the pre-chamber and the cylinder. Purging residual gas from the pre-chamber during a compression stroke of the cylinder may increase a volume of fresh fuel and air in the pre-chamber for a subsequent combustion event.

However, in the case of a catalyst heating condition, when a catalyst (e.g., emission control device 178 of FIG. 1) has not yet reached its light-off temperature where it becomes maximally efficient at treating exhaust gas emissions, traditional compression stroke purging may not provide, or even decrease, turbulence (such as swirl or tumble) that is desired to aid the late ignition phasing desired for the catalyst heating condition. Further, the cylinder may be operated at a relatively high dilution in order to decrease emissions prior to catalyst light-off, which may further impede pre-chamber ignition.

Figure 3:
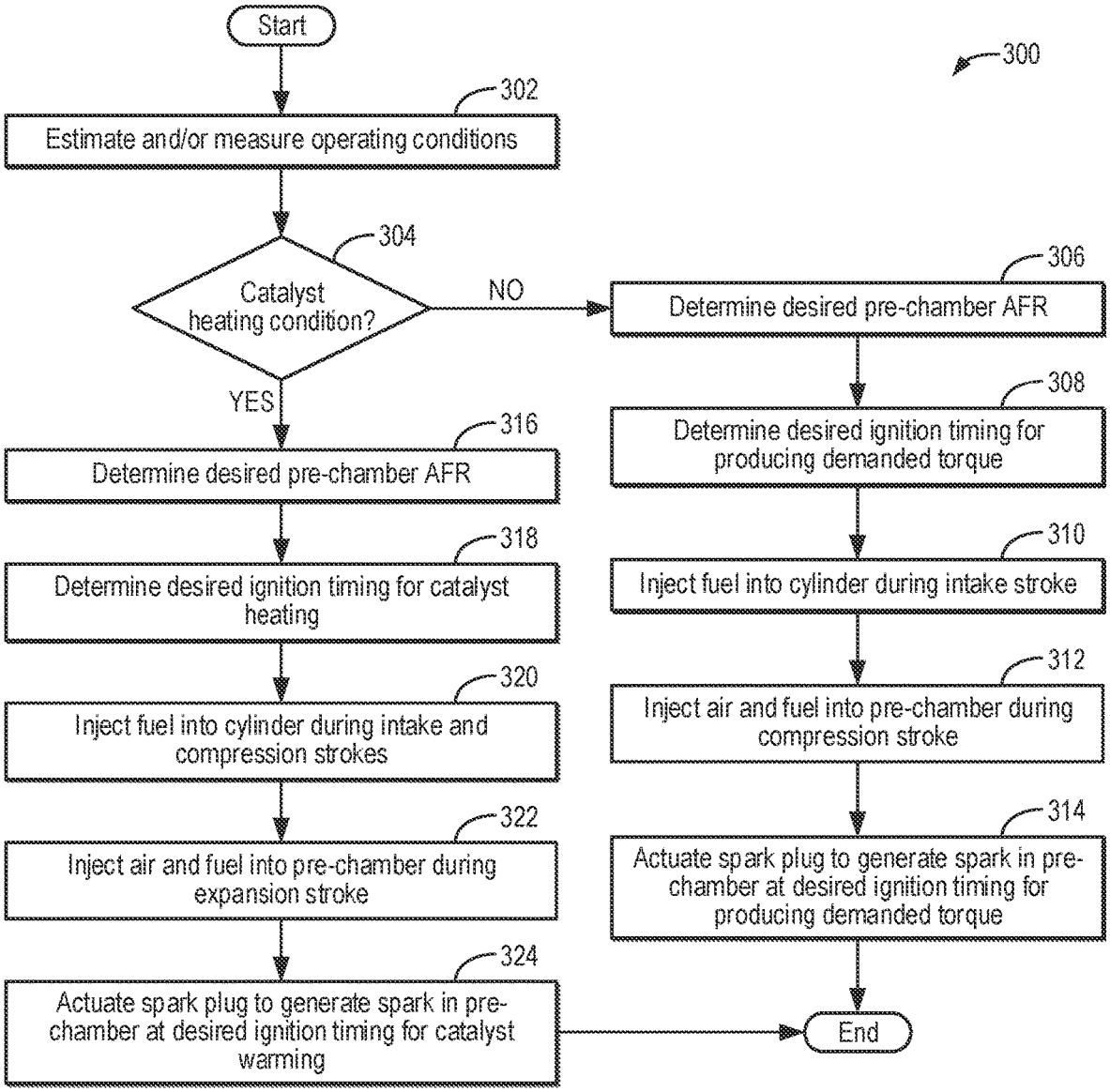
FIG. 3 shows an example method for controlling purge and ignition timings in a pre-chamber.

Thus, FIG. 3 shows an example method for operating a pre-chamber and a cylinder of an engine to provide ignition during catalyst heating and when catalyst heating is not requested. Method 300 will be described with respect to engine 10 and the cylinder configurations shown in FIGS. 1-2, although method 300 may be applied in other systems that include a pre-chamber having direct air and fuel injection. Further, method 300 will be described for one pre-chamber and cylinder pair (e.g., one pre-chamber and the corresponding cylinder it is coupled to), although it may be understood that method 300 may be simultaneously and/or sequentially executed for every cylinder of the engine. Instructions for carrying out method 300 may be executed by a controller, such as controller 12 of FIG. 1, based on instructions stored on a memory of the controller and in conjunction with signals received from sensors of the engine system, such as the sensors described above with reference to FIG. 1 and elaborated below. The controller may employ actuators of the pre-chamber ignition system and the cylinder, including one or more of a pre-chamber fuel injector (e.g., pre-chamber fuel injector 96 of FIG. 1), a pre-chamber spark plug (e.g., pre-chamber spark plug 92 of FIGS. 1-2), a pre-chamber air injector (e.g., pre-chamber air injector 94 shown in FIG. 1), a combined air and fuel injector (e.g., injector 296 shown in FIG. 2), and a cylinder fuel injector (e.g., fuel injector 66 of FIGS. 1-2) to adjust engine operation according to the method described below.

At 302, method 300 includes estimating and/or measuring operating conditions. The operating conditions may include, for example, a vehicle speed, an engine speed, an engine load, an engine temperature, an exhaust gas AFR, a temperature of a catalyst (e.g., emission control device 178 of FIG. 1), an accelerator pedal position, and a brake pedal position. The operating conditions may be measured by one or more sensors communicatively coupled to the controller or may be inferred based on available data. For example, the accelerator pedal position may be measured by an accelerator pedal position sensor, such as accelerator pedal position sensor 118 of FIG. 1, and the brake pedal position may be measured by a brake pedal position sensor, such as brake pedal position sensor 119 of FIG. 1. Together, the accelerator pedal position and the brake pedal position may indicate a demanded amount of engine torque. As another example, the exhaust gas AFR may be determined based on an oxygen level detected by an exhaust gas oxygen sensor, such as exhaust gas sensor 128 of FIG. 1. As a further example, the catalyst temperature may be determined based on one or more of the engine temperature, as measured by an engine coolant temperature sensor (e.g., temperature sensor 112 shown in FIG. 1), and an exhaust gas temperature (measured by exhaust gas temperature sensor 158 of FIG. 1, for example).

At 304, it is determined if a catalyst heating condition is present. In one example, the catalyst heating condition may occur during a cold start. As an example, the cold start may be confirmed when the engine temperature is less than a first threshold temperature. The first threshold temperature may correspond to a non-zero, positive temperature value stored in a memory of the controller, above which the engine is considered to be warm and at a steady state operating temperature. As another example, the cold start may be confirmed when the engine temperature is substantially equal to the ambient temperature (e.g., within a threshold of the ambient temperature, such as within 10° C.) at engine start (e.g., when the engine cranked from zero speed to a non-zero speed, with fuel and spark provided to initiated combustion). As still another example, the cold start may be confirmed when the engine has been inactive for greater than a threshold duration, which may correspond to a non-zero amount of time (e.g., minutes, hours, or days) over which the engine is expected to cool to approximately ambient temperature.

Additionally or alternatively, the catalyst heating condition may be confirmed when the temperature of the catalyst is less than a desired operating temperature. As one example, the desired operating temperature may be a light-off temperature of the catalyst. The light-off temperature of the catalyst may be a predetermined, second threshold temperature stored in the memory of the controller at or above which a high catalytic efficiency is achieved, enabling the catalyst to effectively decrease vehicle emissions, for example. The catalyst may be below its light-off temperature when the engine temperature is less than the first threshold temperature, for example.

If the catalyst heating condition is not present, method 300 proceeds to 306 and includes determining a desired pre-chamber AFR (e.g., a ratio of an amount of air injected to an amount of fuel injected into the pre-chamber). In one example, the desired pre-chamber AFR may be determined by the controller based on an AFR of the cylinder so that combustion in the pre-chamber ignites an air-fuel mixture in the cylinder while minimizing emissions. For example, the controller may input the AFR of the cylinder and the current engine operating conditions, such as engine temperature and fuel composition, into one or more look-up tables, function, and maps, which may output the desired pre-chamber AFR to achieve combustion. As an example, the desired AFR of the pre-chamber may be stoichiometry. As another example, the desired AFR of the pre-chamber may be richer than stoichiometry when fuels with higher evaporation temperatures, such as E85, are used in order to account for evaporated fuel that participates in the combustion and non-evaporated fuel that does not participate in combustion to achieve a substantially stoichiometry combustion with the evaporated fuel. As yet another example, the desired AFR of the pre-chamber may be adjusted from stoichiometry when an operating AFR of the cylinder is adjusted from stoichiometry such that when the combustion gases from the cylinder and the pre-chamber are combined, the combined gases have an AFR approximately equal to stoichiometry.

At 308, method 300 includes determining a desired ignition timing for producing the demanded amount of engine torque (e.g., a desired torque output). Thus, responsive to the catalyst heating condition not being present, the desired ignition timing may be determined based on the desired torque output. Determining the desired ignition timing may include determining when to ignite the air-fuel mixture in the pre-chamber relative to a position of a piston of the cylinder. Although a cylinder spark plug firing induces combustion in a cylinder of a traditional spark-ignition engine, in an engine with pre-chamber ignition, combustion in the pre-chamber initiates combustion in the cylinder. Thus, just as cylinder spark timing in the traditional spark-ignition engine may be adjusted relative to the spark timing for maximum brake torque (MBT) based on engine operating conditions, pre-chamber spark timing may be shifted relative to MBT based on the engine operating conditions in order to achieve the desired ignition timing. For example, the pre-chamber spark timing may be advanced closer to MBT timing to increase a torque output of the cylinder. In one example, the controller may input one or more engine operating conditions (e.g., the demanded amount of engine torque, engine speed, engine load, the exhaust gas temperature, desired pre-chamber AFR, and cylinder AFR) into one or more look-up tables, functions, or maps to determine the desired ignition timing. In another example, the controller may make a logical determination (e.g., regarding the pre-chamber spark timing) based on logic rules that are a function of the one or more engine operating conditions, including the demanded amount of engine torque.

At 310, method 300 includes injecting fuel into the cylinder during an intake stroke of the cylinder. The controller may adjust an amount of fuel to inject into the cylinder (e.g., a cylinder fuel injection amount) based on a desired AFR of the cylinder and an amount of air inducted into the cylinder. For example, the controller may input the desired cylinder AFR and the amount of air inducted into the cylinder into one or more look-up tables, functions, or maps, which may output the fuel injection amount that will achieve the desired AFR in the cylinder. Further, an injection pressure and timing may be determined to increase a burn rate and/or an ignitibility of the air-fuel mixture in the cylinder. For example, the controller may input the desired cylinder AFR and engine operating conditions, such as engine load, into one or more look-up tables, functions, and maps, which may output the desired fuel injection amount. In one example, the controller may inject the desired fuel injection amount by adjusting a pulse-width of an actuation signal sent to the cylinder fuel injector, such as FPW1 shown in FIG. 1. In some examples, injecting fuel into the cylinder during the intake stroke may include introducing the determined fuel injection amount during a single injection event or distributed over a plurality of injection events. Further, in some examples, additional cylinder fuel injection events may occur outside of the intake stroke, such as during the compression stroke. However, a majority of the total fuel injection amount may be delivered during the intake stroke.

At 312, method 300 includes injecting air and fuel into the pre-chamber during the compression stroke. As one example, the air and fuel may be injected into the pre-chamber after the cylinder fuel injection occurs. In other examples, the air and fuel may be injected into the pre-chamber before the cylinder fuel injection occurs. The pre-chamber air injection and the pre-chamber fuel injection may occur sequentially or at a same timing (particularly when a combined air and fuel injector is used, such as injector 296 of FIG. 2). For example, the air may be injected into the pre-chamber at a first timing, and the fuel may be injected into the pre-chamber at a second timing. By injecting air and fuel into the pre-chamber during the compression stroke, residual gas in the pre-chamber from the previous combustion cycle as well as gas that gets pushed into the pre-chamber from the main chamber (e.g., cylinder) during the compression stroke can be pushed back into the main chamber, leaving gas of the desired pre-chamber AFR in the pre-chamber, and particularly in the region of the spark plug.

As an example, when separate pre-chamber air and fuel injectors are used, the controller may adjust an amount of fuel and/or an amount of air injected into the pre-chamber based on the desired pre-chamber AFR, as determined at 306, and the position of the piston within the cylinder, which affects a pressure differential between the pre-chamber and the cylinder. For example, the controller may input the engine operating conditions, including the piston position and the desired AFR of the pre-chamber, into a look-up table, algorithm, or map, which may output a desired pre-chamber air injection amount and/or a desired pre-chamber fuel injection amount. In some examples, the pre-chamber air injection amount may be held substantially constant while only a fuel injection amount is varied to compensate for changes in the desired AFR. For example, the desired pre-chamber air injection amount may be approximately equal to a volume of the pre-chamber. After determining the amount of air to be injected and the amount of fuel to be injected in the pre-chamber, the controller may inject the desired pre-chamber air injection amount by adjusting a pulse-width of an actuation signal sent to the pre-chamber air injector, such as APW shown in FIG. 1, and inject the desired pre-chamber fuel injection amount by adjusting a pulse-width of a different actuation signal sent to the pre-chamber fuel injector, such as FPW2 shown in FIG. 1.

Alternatively, when the combined air and fuel injector is used, the controller may inject pre-mixed air and fuel of the desired pre-chamber AFR. For example, air and fuel may be delivered to a delivery passage (e.g., delivery passage 290 of FIG. 2) in proportion to the desired pre-chamber AFR. The controller may deliver a desired amount (e.g., volume or mass) of the pre-mixed air and fuel by adjusting a pulse-width of an actuation signal sent to the combined air and fuel injector. As another example, air and fuel may be directly delivered to the combined air and fuel injector (e.g., from an air system, such as air system 190 of FIGS. 1 and 2, and a fuel system, such as fuel system 180 of FIGS. 1 and 2, respectively) in proportion to the desired pre-chamber AFR.

Note that in some examples, an intake stroke purge injection may be performed in addition to or as an alternative to the compression stroke purge injection. The intake stroke purge injection may be performed during conditions where there is relatively little residual gas within the cylinder, such as during high load conditions. In such examples, purging the pre-chamber during the intake stroke may be desired due the low cylinder pressure present during the intake stroke, resulting in lower purge flows and injection pressures being used.

At 314, method 300 includes actuating the spark plug to generate a spark in the pre-chamber at the desired ignition timing for the producing the demanded amount of engine torque. The controller may generate a control signal (e.g., signal SA) that is sent to an ignition system (e.g., ignition system 88 of FIGS. 1 and 2) to actuate the pre-chamber spark plug at the spark timing determined at 308. Generating the spark in the pre-chamber initiates combustion of the air-fuel mixture in the pre-chamber, sending jets of hot gas and flame into the cylinder via the pre-chamber openings. The jets of hot gas and flame from the pre-chamber ignite the air-fuel mixture in the cylinder, which produces cylinder (and engine) torque. In particular, the spark timing may be closer to a desired combustion phasing (e.g., a middle point of combustion) when pre-chamber ignition is used (compared with traditional direct spark ignition in the cylinder) due to a faster burn rate achieved through pre-chamber ignition. After 314, method 300 may end.

Returning to 304, if a catalyst heating condition is present, such as when the temperature of the catalyst is less than the desired operating temperature, method 300 proceeds to 316 and includes determining the desired pre-chamber AFR. The desired pre-chamber AFR may be the same or different than when the catalyst heating condition is not present (e.g., as determined at 306). As one example, the desired pre-chamber AFR may be stoichiometry in order to reduce vehicle emissions while the catalyst is below its desired operating temperature and is therefore less efficient at treating exhaust gas emissions.

At 318, method 300 includes determining a desired ignition timing for catalyst heating. For example, combustion phasing may be very late (e.g., compared to when the catalyst heating condition is not present, as at 308) to provide more heat to the catalyst as exhaust waste heat. The late combustion phasing means that flame propagation within the cylinder may occur while the cylinder is expanding. Further, because pre-chamber ignition results in faster burn within the cylinder than traditional direct spark ignition within the cylinder, the desired ignition timing for catalyst heating may be even later than when traditional direct spark ignition of the cylinder air-fuel mixture is used. Therefore, the desired ignition timing for catalyst heating may be later during the expansion stroke than when traditional direct spark ignition of the cylinder is used. As one example, the desired ignition timing for catalyst heating may be at least 50 crank angle degrees after top dead center (TDC) of the compression stroke. The ignition timing may be determined accordingly for achieving a desired combustion phasing for catalyst heating.

Additionally or alternatively, the desired ignition timing for catalyst heating may be adjusted based on a catalyst heating demand. The catalyst heating demand increases as a difference between the temperature of the catalyst and the desired operating temperature increases. Further, the desired ignition timing for catalyst heating may be further delayed as the catalyst heating demand increases. As an example, the controller may input the catalyst temperature into a look-up table, algorithm, or map stored in memory, which may output the desired ignition timing for catalyst heating for the given catalyst temperature (and thus the catalyst heating demand). Thus, responsive to the catalyst heating condition being present, the desired ignition timing may be determined based on the catalyst heating demand.

At 320, method 300 includes injecting fuel into the cylinder during the intake and compression strokes, such as in the manner described above with respect to 310. In some examples, the cylinder fuel injection during both the intake and compression strokes may occur later when the catalyst heating condition is present (e.g., relative to when the catalyst heating condition is not present, such as at 310). Further, the cylinder may be operated with relative high engine dilution in order to reduce vehicle emissions prior to the catalyst reaching its desired operating temperature, such as by providing external and/or internal EGR. As an example, due to combustion in the pre-chamber initiating combustion in the cylinder (instead of a spark directly igniting the air/fuel mixture in the cylinder), the cylinder may be operated with a higher amount of EGR than when traditional spark ignition is used, as the dilute mixture in the cylinder may be more difficult to ignite using traditional spark ignition. As another example, the cylinder AFR may be different than when the catalyst heating condition is not present in order to minimize emissions before the catalyst reaches its light-off temperature. Further still, a larger and later compression stroke injection of fuel may be performed compared to when the catalyst heating condition is not present, at least in some examples. Further still, in some examples, only the intake stroke injection may be performed.

At 322, method 300 includes injecting air and fuel into the pre-chamber during the expansion stroke. For example, high cylinder pressures near the end of the compression stroke (and the beginning of an expansion stroke) may result in additional high-EGR gas being pushed into the pre-chamber prior to the late ignition timing. Cylinder pressures near TDC may be around 20 bar, which would result in very high air pressures being used to push out gases that came from the cylinder, referred to herein as pre-chamber purging. Therefore, the air and fuel may be injected into the pre-chamber during the expansion stroke when the pressure in the cylinder is less than or equal to a threshold pressure. The threshold pressure is a non-zero, positive pressure value stored in controller memory that corresponds to a cylinder pressure above which incomplete pre-chamber purging may occur. As one example, the threshold pressure is approximately 3 bar. For example, by 50 degrees after TDC during the expansion stroke, the pressure is only around 3 bar. Therefore, the air and fuel may be injected into the pre-chamber at or around 50 degrees after TDC, just prior to the desired ignition timing. In other examples, the threshold pressure may be higher, such as when a higher purge injection is available. In such examples, the air and fuel may be injected into the pre-chamber earlier than 50 degrees after TDC, such as in a range between 20 and 50 degrees after TDC. In some examples, the air and fuel may be injected into the pre-chamber no earlier than 20 degrees after TDC. Further, the air and fuel may be injected simultaneously in a close-coupled manner (e.g., air and fuel streams may be adjacent or overlapping), using an air-assisted injector (using the air pressure to help atomize the fuel), or using the combined air and fuel injector. As such, the desired pre-chamber AFR may be achieved prior to the desired ignition timing, with low residual gas and high turbulence for consistent ignition and fast combustion in the pre-chamber.

As an example, the controller may determine the pre-chamber air and fuel injection timing for catalyst heating based on a plurality of operating conditions, including the desired ignition timing for catalyst heating and operating conditions for inferring the in-cylinder pressure at a given engine position. For example, the controller may input the plurality of operating conditions, such as a purge pressure that can be achieved via the pre-chamber air and/or fuel injectors, a compression ratio of the cylinder, a piston position, a cam timing, and a desired mixing time before the desired ignition timing for catalyst heating into one or more look-up tables, algorithms, or maps stored in memory, which may output the pre-chamber air and fuel injection timing. For example, at least the piston position may be used to infer the pressure of the cylinder at the given compression ratio when the pressure of the cylinder is not directly measured. The controller may then transmit signals to the pre-chamber air and fuel injectors (or a single signal to the combined air and fuel injector) to inject a desired amount of air and fuel at the determined injection timing for catalyst heating that will result in effective pre-chamber purging, turbulence generation, and the desired pre-chamber AFR for catalyst heating. Thus, the pre-chamber air and fuel injection may occur while the pressure in the cylinder is less than the threshold pressure at a timing that is adjusted based on the desired ignition timing so that turbulence in the pre-chamber is not dissipated prior to ignition.

At 324, method 300 includes actuating the spark plug to generate spark in the pre-chamber at the desired ignition timing for catalyst warming, similar to the manner described at 314. As discussed above, the spark may occur shortly after the pre-chamber air and fuel injection so that turbulence created through the pre-chamber air and fuel injection has not yet dissipated and while the AFR of the gases near the spark plug are the desired pre-chamber AFR. Further, a duration between injecting air and fuel into the pre-chamber and actuating the spark plug may be smaller (e.g., shorter) when the catalyst heating condition is present compared to when the catalyst heating condition is not present, as will also be illustrated below with respect to FIGS. 4 and 5. Method 300 may then end. For example, method 300 may be repeated at a pre-determined frequency during engine operation to provide robust pre-chamber ignition to the cylinder across a variety of operating conditions, including catalyst heating.

In this way, pre-chamber ignition may reliably initiate combustion in the cylinder during catalyst heating. As a result, ignition may be provided without inclusion of an additional spark plug directly coupled to the cylinder, reducing vehicle costs and packaging space issues. In addition, the fast, repeatable combustion provided via pre-chamber ignition may enable higher dilution to be used during catalyst heating, thereby reducing emissions during an engine cold start, for example. Furthermore, the pre-chamber may continue to provide robust ignition to the cylinder after the catalyst reaches its light-off temperature, such as by adjusting the ignition timing based on the desired torque output and not based on the temperature of the catalyst after the catalyst reaches its light-off temperature.

Next, FIG. 4 shows an example timing chart 400 demonstrating operating a pre-chamber of a cylinder when a catalyst heating condition is not present. As described above with respect to FIG. 3, the catalyst heating condition is not present when a temperature of a catalyst coupled downstream of the cylinder is above its light-off temperature, for example. In particular, the pre-chamber is an active pre-chamber comprising direct air and fuel injection. The cylinder may be cylinder 130 of engine 10 including pre-chamber 138 shown in FIGS. 1 and 2, for example. Timing chart 400 shows the cylinder operating during a single combustion cycle, wherein the combustion cycle (e.g., cylinder cycle) refers to four strokes of a piston within the cylinder (e.g., intake, compression, expansion, and exhaust). A piston position relative to top dead center (TDC, the point at which the piston is closest to the cylinder head and a volume in the cylinder is smallest), bottom dead center (BDC, the point at which the piston is farthest from the cylinder head and the volume in the cylinder is largest), and the four strokes of the combustion cycle is shown in a plot 402. Further, a pressure in the cylinder (e.g., cylinder pressure) is shown in a plot 404. A pre-chamber fuel injection signal is shown in a plot 406, a pre-chamber air injection signal is shown in plot 408, and a pre-chamber spark plug actuation signal is shown in a plot 410. Further, atmospheric pressure is shown by a dashed line 412, and a threshold cylinder pressure is shown by a dashed line 414.

For all of the above, the horizontal axis represents engine position (in crank angle degrees, CAD), with the engine position increasing along the horizontal axis from left to right. For example, as mentioned above, one combustion cycle is shown, which occurs from 0 to 720 CAD (e.g., two full rotations of an engine crankshaft). In the example of timing chart 400, the intake stroke corresponds to an interval from 0 CAD to 180 CAD, the compression stroke corresponds to an interval from 180 CAD to 360 CAD, the expansion (or power) stroke corresponds to an interval from 360 CAD to 540 CAD, and the exhaust stroke corresponds to an interval from 540 CAD to 720 CAD. The vertical axis of each plot represents the labeled parameter. For plot 402, the vertical axis shows piston position relative to TDC. For plot 404, the cylinder pressure increases up the vertical axis from bottom to top. For each of the plots 406, 408, and 410, the vertical axis indicates whether the signal is on (e.g., the corresponding injector or spark plug is actuated) or off (e.g., the corresponding injector or spark plug is not actuated), as labeled.

The piston position (plot 402) decreases throughout the intake stroke. The cylinder pressure (plot 404) decreases relative to atmospheric pressure (dashed line 412) throughout the intake stroke as a volume of the cylinder increases. As fresh air flows into the cylinder through an open intake valve (not shown), an amount may flow into the pre-chamber via openings in a wall of the pre-chamber that fluidically couple the pre-chamber and the cylinder. However, the pre-chamber may largely hold residual gas from the previous combustion cycle during the intake stroke. Further, fuel may be injected into the cylinder during the intake stroke via one or more injections (not shown).

At the beginning of the compression stroke (e.g., around 180 CAD) during the combustion cycle, the intake valve closes. The piston (plot 402) moves toward the cylinder head so as to compress the air and fuel within the cylinder, causing the cylinder pressure (plot 404) to increase. Later in the combustion cycle during the compression stroke, as the piston moves toward TDC (plot 402), gases from the cylinder are pushed into the pre-chamber via the openings in the pre-chamber wall. However, residual gases from the previous combustion cycle may remain in the pre-chamber, particularly in a top portion of the pre-chamber proximate to the spark plug. Therefore, during the compression stroke at an engine position CAD1, a pre-chamber fuel injection event (plot 406) introduces fuel into the pre-chamber and a pre-chamber air injection event (plot 408) introduces air into the pre-chamber, which creates an air-fuel mixture in the pre-chamber increases the pre-chamber pressure. Further, because the cylinder pressure is relatively low at CAD1 and is less than the threshold cylinder pressure (dashed line 414), the injection of air and fuel into the pre-chamber pushes out remaining residuals and gases introduced from the cylinder during the compression stroke. Note that while air and fuel are both injected into the pre-chamber at CAD1 in the example of timing chart 400, in other examples, the injection timings may be offset or staggered (e.g., may occur at different engine positions/timings). Further, in other examples, the air and fuel may be injected into the pre-chamber during the intake stroke, such as described above at 312 of FIG. 3.

Just before the end of the compression stroke at an engine position CAD2 during the combustion cycle, the spark plug is actuated (plot 410) to trigger combustion of the air-fuel mixture in the pre-chamber. Combustion in the pre-chamber causes jets of hot gas and flame to exit the pre-chamber and ignite the air-fuel mixture in the cylinder, thus providing power to drive down the piston during the expansion stroke. Further, the combustion reaction in the cylinder causes the cylinder pressure (plot 404) to increase. Note that the high pressures during combustion are cropped from view in FIG. 4 due to the high magnitude of the peak combustion pressures relative to the pressures in the other portions of the combustion cycle (e.g., the intake stroke). A timing of actuating the spark plug may be adjusted based on a desired torque output, for example.

At the end of the expansion stroke, an exhaust valve opens (not shown) to allow exhaust gas to flow from the cylinder. The exhaust valve may remain open during at least the exhaust stroke (e.g., from 540 CAD to 720 CAD). During the exhaust stroke, a relatively large amount of residual gas remains in the pre-chamber. Further, the residual gas may remain in the pre-chamber until purged during a subsequent combustion cycle.

Continuing to FIG. 5, an example timing chart 500 demonstrating operating the pre-chamber of the cylinder when the catalyst heating condition present is shown. As described above with respect to FIG. 3, the catalyst heating condition is present when the temperature of the catalyst coupled downstream of the cylinder is less than its light-off temperature, for example. Parameters shown in FIG. 5 are the same as those shown in FIG. 4 except for the differences described below. Thus, the plots are numbered the same and will not be re-introduced.

Similar to timing chart 400 shown in FIG. 4, as the piston moves toward TDC (plot 402) during the compression stroke, gases from the cylinder are pushed into the pre-chamber via the openings in the pre-chamber wall. However, unlike in timing chart 400 of FIG. 4, residual gases from the previous combustion cycle may remain in the pre-chamber throughout the compression stroke, as turbulence created if the pre-chamber were purged during the compression stroke may decay before the late ignition timing used to facilitate catalyst warming. Further still, the cylinder pressure (plot 404) is relatively high at the beginning of the expansion stroke, which may impede pre-chamber purging. Therefore, a pre-chamber fuel injection event (plot 406) introduces fuel into the pre-chamber and a pre-chamber air injection event (plot 408) introduces air into the pre-chamber after the cylinder pressure (plot 404) decreases below the threshold cylinder pressure (dashed line 414) during the expansion stroke at CAD3, the timing of which is determined based on a desired ignition timing for catalyst heating via late combustion phasing. Due to the relative low cylinder pressure at CAD3 (plot 404), the injections effectively push out residuals and high-EGR gases pushed in from the cylinder during the compression stroke. The injections also create a substantially homogenous air-fuel mixture in the pre-chamber with high turbulence, which is quickly ignited by actuating the spark plug at CAD4 (plot 410).

The combustion in the pre-chamber causes jets of hot gas and flame to exit the pre-chamber and ignite the high dilution air-fuel mixture in the cylinder, creating cylinder torque and waste heat for warming the catalyst. As a result, the temperature of the catalyst may be increased more quickly using the parameter timings shown in timing chart 500 relative to the parameter timings shown in timing chart 400 of FIG. 4.

Turning now to FIG. 6, an example timeline 600 for adjusting a purge timing and an ignition timing of pre-chambers of an engine based on whether a catalyst heating condition is present is shown. The engine may be engine 10 shown in FIG. 1 including pre-chamber 138, for example. An engine status is shown in a plot 601, a temperature of a catalyst (e.g., emission control device 178 of FIG. 1) is shown in a plot 602, a pre-chamber injection timing (e.g., of air and fuel) is shown in a plot 604, and a pre-chamber spark timing (e.g., an actuation timing of a pre-chamber spark plug) is shown in a plot 606. For all of the above, the horizontal axis represents time, with time increasing along the horizontal axis from left to right. The vertical axis represents each labeled parameter. For plot 601, the vertical axis shows the engine status as "on," wherein combustion occurs within engine cylinders, and "off," wherein combustion is discontinued. For plot 602, the catalyst temperature increases up the vertical axis from bottom to top. For plots 604 and 606, the corresponding timing is shown relative to TDC of the compression stroke, represented by a dashed line, with timings below the dashed line corresponding to timings that occur before TDC and timings above the dashed line corresponding to timings that occur after TDC, as labeled. Further, a threshold catalyst temperature is represented by a dashed line 608 and corresponds to a light-off temperature of the catalyst.

At time t0, the engine is off (plot 601). For example, an engine start has not yet occurred. With the engine off and combustion not occurring, the catalyst temperature (plot 602) is relatively low. For example, the catalyst temperature may be approximately equal to ambient temperature.

At time t1, the engine is started (plot 602). Because the catalyst temperature (plot 602) is less than the threshold catalyst temperature (dashed line 608), a catalyst heating condition is present. Responsive to the catalyst heating condition being present, air and fuel is injected into the pre-chamber at an injection timing that is after TDC of the compression stroke, during the expansion stroke (plot 604). The air and fuel may be injected via a single, combined injector, such as injector 296 of FIG. 2, or via separate air and fuel injectors, such as air injector 94 and fuel injector 96 shown in FIG. 1. This late purge injection pushes residuals and cylinder gases out of the pre-chamber due to a relatively low cylinder pressure at this timing (e.g., less than or equal to a threshold cylinder pressure, as described above with respect to FIGS. 3 and 5). The late purge injection also enables efficient ignition upon actuating the pre-chamber spark plug (e.g., spark plug 92 of FIGS. 1 and 2), which also occurs in the expansion stroke, after the injection of air and fuel (plot 606).

Between time t1 and time t2, the late pre-chamber spark timing expedites catalyst heating, and the temperature of the catalyst increases (plot 602). Further, the pre-chamber spark timing (plot 606) is adjusted based on the catalyst temperature (plot 602) relative to the threshold catalyst temperature (dashed line 608), with the pre-chamber spark timing occurring earlier (e.g., closer to TDC of the compression stroke) as a difference between the catalyst temperature and the threshold catalyst temperature decreases.

At time t2, the catalyst temperature (plot 602) reaches the threshold catalyst temperature (dashed line 608). In response, the pre-chamber injection timing (plot 604) and the pre-chamber spark timing (plot 606) are both adjusted to occur during the compression stroke, prior to TDC, to facilitate engine torque production. In particular, the pre-chamber spark timing (plot 606) is adjusted based on a torque demand (not shown), and not based on the catalyst temperature (plot 602), after the catalyst temperature reaches the threshold catalyst temperature (dashed line 608) at time t2. The pre-chamber injection timing (plot 604) occurs when the cylinder pressure is relatively low (e.g., less than the threshold cylinder pressure, as described above with respect to FIGS. 3 and 4), effectively purging residual gases from the previous combustion cycle and gases pushed in from the cylinder out of the pre-chamber. As a result, pre-chamber ignition robustly occurs at the pre-chamber spark timing (plot 606), which occurs just before TDC in the example shown.

In this way, a pre-chamber may be operated to purge residual gases and produce a desired AFR for pre-chamber ignition even during catalyst heating. By injecting air and fuel into the pre-chamber during the expansion stroke just prior to a late phased ignition timing, turbulence is generated that increases a burn rate of the subsequently ignited air and fuel. As a result, the pre-chamber ignition may provide fast burn rates for robust cylinder ignition even at high EGR dilution levels, increasing a fuel efficiency of the vehicle and decreasing vehicle emissions. Further, inclusion of an additional spark plug directly coupled to the cylinder may be avoided, thereby reducing a cost of the system.

The technical effect of adjusting both a timing of purging gases from a pre-chamber to a cylinder and a spark timing in the pre-chamber responsive to a cold start condition is that the pre-chamber provides robust cylinder ignition while cold start emissions are reduced.

In one example, a method comprises: injecting fuel and air into a pre-chamber of an engine cylinder during an expansion stroke of the engine cylinder responsive to a desired spark timing being after top dead center of a compression stroke of the engine cylinder, and injecting the fuel and the air into the pre-chamber during the compression stroke of the engine cylinder responsive to the desired spark timing being before top dead center of the compression stroke. In a first example of the method, the method further comprises: actuating a spark plug of the pre-chamber during the expansion stroke, after injecting the fuel and the air into the pre-chamber, responsive to the desired spark timing being after top dead center of the compression stroke of the engine cylinder, and actuating the spark plug of the pre-chamber during the compression stroke, after injecting the fuel and the air into the pre-chamber, responsive to the desired spark timing being before top dead center of the compression stroke. In a second example of the method, optionally including the first example, the desired spark timing is after top dead center of the compression stroke while a temperature of a catalyst is less than a threshold temperature and is before top dead center of the compression stroke while the temperature of the catalyst is greater than or equal to the threshold temperature, and wherein actuating the spark plug of the pre-chamber comprises actuating the spark plug of the pre-chamber at the desired spark timing. In a third example of the method, optionally including one or both of the first and second examples, the desired spark timing is determined based on the temperature of the catalyst while the temperature of the catalyst is less than the threshold temperature and is determined based on a desired torque output of the engine cylinder, and not the temperature of the catalyst, while the temperature of the catalyst is greater than or equal to the threshold temperature. In a fourth example of the method, optionally including any or all of the first through third examples, the pre-chamber includes a single injector, and injecting the fuel and the air into the pre-chamber during the expansion stroke comprises actuating the single injector after a pressure in the engine cylinder decreases to a threshold pressure during the expansion stroke. In a fifth example of the method, optionally including any or all of the first through fourth examples, the fuel and the air is delivered to the single injector as a mixture, and actuating the single injector injects the mixture. In a sixth example of the method, optionally including any or all of the first through fifth examples, the single injector is an air-assisted fuel injector. In a seventh example of the method, optionally including any or all of the first through sixth examples, injecting the fuel and the air into the pre-chamber during the expansion stroke of the engine cylinder comprises injecting the fuel and the air into the pre-chamber no earlier than 20 degrees after top dead center during the expansion stroke. In an eighth example of the method, optionally including any or all of the first through seventh examples, the pre-chamber includes a fuel injector and an air injector, and injecting the fuel and the air into the pre-chamber during the expansion stroke of the engine cylinder comprises actuating both of the fuel injector and the air injector after a pressure in the engine cylinder decreases to a threshold during the expansion stroke.

As another example, a method comprises: during a cold start of an engine: purging a pre-chamber coupled to a cylinder of the engine during an expansion stroke of the cylinder, and actuating a spark plug of the pre-chamber during the expansion stroke of the cylinder, after the purging, at a first spark timing determined based on a temperature of an emission control device coupled to the engine. In a first example of the method, the first spark timing is further delayed as a difference between the temperature of the emission control device and a light-off temperature of the emission control device increases and is less delayed as the difference decreases. In a second example of the method, optionally including the first example, purging the pre-chamber coupled to the cylinder during the expansion stroke of the cylinder comprises injecting air and fuel into the pre-chamber during the expansion stroke of the cylinder at a timing determined based on a pressure in the cylinder. In a third example of the method, optionally including one or both of the first and second examples, the pressure in the cylinder is measured or inferred based on at least a piston position in the cylinder, and the pressure in the cylinder is less than or equal to a threshold pressure at the timing. In a fourth example of the method, optionally including any or all of the first through third examples, injecting the air and the fuel into the pre-chamber includes injecting the air and the fuel into the pre-chamber via a single injector coupled to the pre-chamber. In a fifth example of the method, optionally including any or all of the first through fourth examples, the cold start of the engine is present when the temperature of the emission control device is less than a threshold temperature, and the method further comprises: responsive to the temperature of the emission control device reaching the threshold temperature: purging the pre-chamber during a compression stroke of the cylinder, and actuating the spark plug of the pre-chamber during the compression stroke of the cylinder, after the purging, at a second spark timing determined based on a desired torque output.

As yet another example, a system comprises: an engine including a plurality of cylinders, each cylinder including a pre-chamber of a pre-chamber ignition system, the pre-chamber fluidically coupled to the corresponding cylinder via an orifice, and a controller storing executable instructions in non-transitory memory that, when executed, cause the controller to: purge gases from the pre-chamber to the corresponding cylinder during an expansion stroke of the corresponding cylinder when an emission control device heating condition is present and during a compression stroke of the corresponding cylinder when the emission control device heating condition is not present, and initiate combustion in the pre-chamber after purging the gases from the pre-chamber. In a first example of the system, each pre-chamber includes a spark plug coupled thereto, and wherein to initiate combustion in the pre-chamber after purging the gases from the pre-chamber, the controller includes further instructions stored in non-transitory memory that, when executed, cause the controller to: determine a desired ignition timing, and actuate the spark plug at the desired ignition timing. In a second example of the system, optionally including the first example, the system further comprises an emission control device coupled in an exhaust system of the engine, the emission control device heating condition corresponding to a temperature of the emission control device being less than a threshold temperature, and to determine the desired ignition timing, the controller includes further instructions stored in non-transitory memory that, when executed, cause the controller to: determine the desired ignition timing based on the temperature of the emission control device when the emission control device heating condition is present, and determine the desired ignition timing based on a desired torque output of the engine when the emission control device heating condition is not present. In a third example of the system, optionally including one or both of the first and second examples, each pre-chamber includes an air injector and a fuel injector coupled thereto, and to purge gases from the pre-chamber to the corresponding cylinder, the controller includes further instructions stored in non-transitory memory that, when executed, cause the controller to: inject air into the pre-chamber via the air injector at a first timing and inject fuel into the pre-chamber via the fuel injector at a second timing, wherein a duration between the first timing and the desired ignition timing is smaller when the emission control device heating condition is present compared to when the emission control device heating condition is not present. In a fourth example of the system, optionally including any or all of the first through third examples, each pre-chamber includes an injector coupled thereto, and to purge gases from the pre-chamber to the corresponding cylinder, the controller includes further instructions stored in non-transitory memory that, when executed, cause the controller to: inject air and fuel into the pre-chamber via the injector when a pressure in the corresponding cylinder is less than a threshold.

In another representation, a method comprises: adjusting a purge timing of a pre-chamber coupled to an engine cylinder based on a desired ignition timing. In the preceding example, additionally or optionally, adjusting the purge timing of the pre-chamber based on the desired ignition timing includes differently adjusting the purge timing when the desired ignition timing is within an expansion stroke of the engine cylinder compared to when the desired ignition timing is within a compression stroke of the engine cylinder. In one or both of the preceding examples, additionally or optionally, differently adjusting the purge timing when the desired ignition timing is within the expansion stroke of the engine cylinder compared to when the desired ignition timing is within the compression stroke of the engine cylinder comprises: setting the purge timing to be further before the desired ignition timing when the desired ignition timing is within the compression stroke of the engine cylinder compared to when the desired ignition timing is within the expansion stroke of the engine cylinder. In any or all of the preceding examples, the desired ignition timing is within the expansion stroke of the engine cylinder when a cold start condition is present. In any or all of the preceding examples, the method additionally or optionally further comprises: injecting air and fuel into the pre-chamber at the purge timing.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations, and/or functions may be repeatedly performed depending on the particular strategy being used. Further, the described actions, operations, and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

injecting fuel and air into a pre-chamber of an engine cylinder during an expansion stroke of the engine cylinder responsive to a desired spark timing being after top dead center of a compression stroke of the engine cylinder; and injecting the fuel and the air into the pre-chamber during the compression stroke of the engine cylinder responsive to the desired spark timing being before top dead center of the compression stroke.

2. The method of claim 1, further comprising:

actuating a spark plug of the pre-chamber during the expansion stroke, after injecting the fuel and the air into the pre-chamber, responsive to the desired spark timing being after top dead center of the compression stroke of the engine cylinder; and actuating the spark plug of the pre-chamber during the compression stroke, after injecting the fuel and the air into the pre-chamber, responsive to the desired spark timing being before top dead center of the compression stroke.

3. The method of claim 2, wherein the desired spark timing is after top dead center of the compression stroke while a temperature of a catalyst is less than a threshold temperature and is before top dead center of the compression stroke while the temperature of the catalyst is greater than or equal to the threshold temperature, and wherein actuating the spark plug of the pre-chamber comprises actuating the spark plug of the pre-chamber at the desired spark timing.

4. The method of claim 3, wherein the desired spark timing is determined based on the temperature of the catalyst while the temperature of the catalyst is less than the threshold temperature and is determined based on a desired torque output of the engine cylinder, and not the temperature of the catalyst, while the temperature of the catalyst is greater than or equal to the threshold temperature.

5. The method of claim 1, wherein the pre-chamber includes a single injector, and injecting the fuel and the air into the pre-chamber during the expansion stroke comprises actuating the single injector after a pressure in the engine cylinder decreases to a threshold pressure during the expansion stroke.

6. The method of claim 5, wherein the fuel and the air is delivered to the single injector as a mixture, and actuating the single injector injects the mixture.

7. The method of claim 5, wherein the single injector is an air-assisted fuel injector.

8. The method of claim 1, wherein injecting the fuel and the air into the pre-chamber during the expansion stroke of the engine cylinder comprises injecting the fuel and the air into the pre-chamber no earlier than 20 degrees after top dead center during the expansion stroke.

9. The method of claim 1, wherein the pre-chamber includes a fuel injector and an air injector, and injecting the fuel and the air into the pre-chamber during the expansion stroke of the engine cylinder comprises actuating both of the fuel injector and the air injector after a pressure in the engine cylinder decreases to a threshold during the expansion stroke.

10. A method, comprising:

during a cold start of an engine:

purging a pre-chamber coupled to a cylinder of the engine during an expansion stroke of the cylinder; and actuating a spark plug of the pre-chamber during the expansion stroke of the cylinder, after the purging, at a first spark timing determined based on a temperature of an emission control device coupled to the engine.

11. The method of claim 10, wherein the first spark timing is further delayed as a difference between the temperature of the emission control device and a light-off temperature of the emission control device increases and is less delayed as the difference decreases.

12. The method of claim 10, wherein purging the pre-chamber coupled to the cylinder during the expansion stroke of the cylinder comprises injecting air and fuel into the pre-chamber during the expansion stroke of the cylinder at a timing determined based on a pressure in the cylinder.

13. The method of claim 12, wherein the pressure in the cylinder is measured or inferred based on at least a piston position in the cylinder, and the pressure in the cylinder is less than or equal to a threshold pressure at the timing.

14. The method of claim 12, wherein injecting the air and the fuel into the pre-chamber includes injecting the air and the fuel into the pre-chamber via a single injector coupled to the pre-chamber.

15. The method of claim 10, wherein the cold start of the engine is present when the temperature of the emission control device is less than a threshold temperature, and the method further comprises:

responsive to the temperature of the emission control device reaching the threshold temperature:

purging the pre-chamber during a compression stroke of the cylinder; and actuating the spark plug of the pre-chamber during the compression stroke of the cylinder, after the purging, at a second spark timing determined based on a desired torque output.

16. A system, comprising:

an engine including a plurality of cylinders, each cylinder including a pre-chamber of a pre-chamber ignition system, the pre-chamber fluidically coupled to the corresponding cylinder via an orifice; and a controller storing executable instructions in non-transitory memory that, when executed, cause the controller to:

purge gases from the pre-chamber to the corresponding cylinder during an expansion stroke of the corresponding cylinder when an emission control device heating condition is present and during a compression stroke of the corresponding cylinder when the emission control device heating condition is not present; and initiate combustion in the pre-chamber after purging the gases from the pre-chamber.

17. The system of claim 16, wherein each pre-chamber includes a spark plug coupled thereto, and wherein to initiate combustion in the pre-chamber after purging the gases from the pre-chamber, the controller includes further instructions stored in non-transitory memory that, when executed, cause the controller to:

determine a desired ignition timing; and actuate the spark plug at the desired ignition timing.

18. The system of claim 17, further comprising an emission control device coupled in an exhaust system of the engine, the emission control device heating condition corresponding to a temperature of the emission control device being less than a threshold temperature, and wherein to determine the desired ignition timing, the controller includes further instructions stored in non-transitory memory that, when executed, cause the controller to:

determine the desired ignition timing based on the temperature of the emission control device when the emission control device heating condition is present; and determine the desired ignition timing based on a desired torque output of the engine when the emission control device heating condition is not present.

19. The system of claim 17, wherein each pre-chamber includes an air injector and a fuel injector coupled thereto, and to purge gases from the pre-chamber to the corresponding cylinder, the controller includes further instructions stored in non-transitory memory that, when executed, cause the controller to:

inject air into the pre-chamber via the air injector at a first timing and inject fuel into the pre-chamber via the fuel injector at a second timing, wherein a duration between the first timing and the desired ignition timing is smaller when the emission control device heating condition is present compared to when the emission control device heating condition is not present.

20. The system of claim 16, wherein each pre-chamber includes an injector coupled thereto, and to purge gases from the pre-chamber to the corresponding cylinder, the controller includes further instructions stored in non-transitory memory that, when executed, cause the controller to:

inject air and fuel into the pre-chamber via the injector when a pressure in the corresponding cylinder is less than a threshold.

* * * * *